US010784063B1

(12) United States Patent
Montich

(10) Patent No.: US 10,784,063 B1
(45) **Date of Patent: *Sep. 22, 2020**

(54) AIR INSULATED GROUNDING SWITCH

(71) Applicant: EMA Electromechanics, Inc., Sweetwater, TX (US)

(72) Inventor: Eduardo Montich, Sweetwater, TX (US)

(73) Assignee: EMA ELECTROMECHANICS, INC., Sweetwater, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/571,580

(22) Filed: Sep. 16, 2019

Related U.S. Application Data

(63) Continuation-in-part of application No. 16/455,306, filed on Jun. 27, 2019.

(51) Int. Cl.
*H01H 31/00* (2006.01)
*H01H 31/02* (2006.01)
*H01H 33/666* (2006.01)

(52) U.S. Cl.
CPC ..... *H01H 31/003* (2013.01); *H01H 31/02* (2013.01); *H01H 33/666* (2013.01); *H01H 2033/6667* (2013.01)

(58) Field of Classification Search
CPC ..... H01H 31/003; H01H 31/02; H01H 31/04; H01H 31/10; H01H 33/52; H01H 33/666; H02B 13/075; H02B 1/16
USPC .. 218/55, 12–14, 43, 45, 67, 68, 70, 71, 79, 218/80, 100, 56; 200/50.39; 361/115, 361/605
See application file for complete search history.

(56) References Cited

U.S. PATENT DOCUMENTS

| | | | |
|---|---|---|---|
| 3,883,706 | A | 5/1975 | Glaser |
| 4,016,385 | A | 4/1977 | Golioto |
| 4,442,329 | A | 4/1984 | Gray et al. |
| 5,612,523 | A | 3/1997 | Hakamata et al. |

(Continued)

FOREIGN PATENT DOCUMENTS

| | | | |
|---|---|---|---|
| EP | 1538650 | A2 | 6/2005 |
| EP | 2704173 | A1 | 3/2014 |

(Continued)

OTHER PUBLICATIONS

International Search Report and Written Opinion for related PCT/US19/49444.

*Primary Examiner* — William A Bolton
(74) *Attorney, Agent, or Firm* — Egbert Law Offices, PLLC

(57) ABSTRACT

A circuit breaker apparatus has a housing, electrical power inlet, electrical power outlet, a main circuit breaker, a grounding switch, and a mechanical linkage. The main circuit breaker and the grounding switch each have a pair of contactors therein. The mechanical linkage is movable between a pair of positions in which one of the positions causes the pair of contactors of the main circuit breaker to close and the pair of contactors of the grounding switch to open and another position in which the pair of contactors of the main circuit breaker are open and such that the pair of contactors of the grounding switch are closed. The housing has an interior that is filled with air. The main circuit breaker and the grounding switch are in non-longitudinal alignment.

16 Claims, 9 Drawing Sheets

(56) References Cited

U.S. PATENT DOCUMENTS 5,796,060 A * 8/1998 Fuchsle ..... H02B 13/035 218/79
6,048,216 A 4/2000 Komuro et al.
6,329,615 B1 12/2001 Biquez
6,462,296 B1 10/2002 Boettcher et al.
6,504,125 B2 * 1/2003 Nishitani ..... H02B 13/045 218/155
6,515,247 B1 2/2003 Tsuzura et al.
6,759,617 B2 7/2004 Yoon
6,951,993 B2 10/2005 Kikukawa et al.
7,091,439 B2 * 8/2006 Vaghini ..... H01H 33/6661 218/154
7,223,932 B2 5/2007 Kobayashi et al.
7,724,489 B2 5/2010 Montich
7,790,997 B2 * 9/2010 Girodet ..... H01H 33/52 218/154
8,081,407 B2 * 12/2011 Willieme ..... H01H 33/6661 218/2
8,174,812 B2 5/2012 Montich
8,467,166 B2 6/2013 Montich
8,946,581 B2 * 2/2015 Yabu ..... H01H 33/66207 218/119
9,070,517 B2 6/2015 Bullock et al.
2006/0186091 A1 * 8/2006 Rokunohe ..... H01H 33/22 218/43
2007/0119818 A1 * 5/2007 Meinherz ..... H01H 31/003 218/13
2010/0258532 A1 * 10/2010 Miller ..... H02B 13/025 218/157
2012/0175234 A1 * 7/2012 Sugai ..... H01H 33/6661 200/5 R
2014/0043714 A1 2/2014 Benke

FOREIGN PATENT DOCUMENTS

JP H05174676 A 7/1993
JP H07161265 A 6/1995
JP H11162303 A 6/1999
JP 2000341858 A 12/2000
JP 2006019193 A 1/2006

* cited by examiner

AIR INSULATED GROUNDING SWITCH

CROSS-REFERENCE TO RELATED APPLICATIONS

The present application is a continuation-in-part of U.S. patent application Ser. No. 16/455,306, filed on Jun. 27, 2019, and entitled "Gas Insulated Grounding Switch", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to vacuum circuit breakers. More particularly, the present invention relates to circuit breakers having a mechanically interlocked grounding switch. Additionally, the present invention relates to circuit breakers with a mechanically-interlocked grounding switch for use in association with wind and solar farm collection circuits.

2. Description of Related Art Including Information Disclosed Under 37 CFR 1.97 and 37 CFR 1.98

Wind farms are becoming increasing popular for the generation of electricity. In a wind farm, there are a large number of wind energy generators installed in locations of the country where wind is consistent and substantial. Typically, the wind energy generators will include an array of blades that are coupled to a shaft. The rotation of the shaft caused by the rotation of the blades will produce electrical energy. Electrical lines will connect with the energy generator so as to deliver the energy from a particular wind energy generator to a collection bus. The electrical energy from the various wind energy generators in the wind farm can collectively pass energy to a substation.

Typically, these wind turbines can each produce between 500 kW and 3500 kW of power. The outputs of generators in the wind farm are often grouped into several electrical collection circuits. Transformers are used so as to tie the wind turbine output to the 34.5 kV collection circuits. The transformers serve to step up the output voltage of the wind energy generators to a medium voltage, usually 34.5 kilovolts. The various wind turbines in a wind farm are usually paralleled into collection circuits that can deliver 15 to 30 megawatts of power. In view of the voltage which has been stepped up to the 34.5 kilovolts, each collection circuit will require a circuit breaker rated at a minimum 34.5 kilovolts capacity. The energy will pass through the circuit breaker to the 34.5 kV bus of a substation. The 34.5 kV substation bus will go into one or more main step-up transformers and then tie into a high voltage utility line. As such, a need has developed so as to provide a circuit breaker that can tie collection circuits into the 34.5 kV substation bus. Such a circuit breaker should be of low cost, weatherproof, and able to effectively break the current in the event of a problem condition or fault.

Typically, with circuit breakers, the circuit to the substation can be broken upon the application of a manual force to a button or lever of the circuit breaker or by an automatic relay which opens the circuit. Typically, the current is measured to the substation. If any relay senses a problem, then a signal is transmitted to the circuit breaker so as to open the breaker. Typically, the relays will be maintained within the substation. The opening of the circuit breaker will prevent the energy from being transmitted to the substation. Sometimes, the circuit breaker is open so as to allow users to work on the wind farm system, on the circuit breaker, or on the substation. Typically, the relays will operate if the sensors sense a voltage drop.

The interruption of electrical power circuits has always been an essential function, especially in cases of overloads or short circuits, when immediate interruption of the current flow becomes necessary as a protective measure. In earliest times, circuits could be broken only by separation of contacts in air followed by drawing the resulting electric arc out to such a length that it can no longer be maintained. This means of interruption soon became inadequate and special devices, termed "circuit breakers", were developed. The basic problem is to control and quench the high power arc. This necessarily occurs at the separating contacts of a breaker when opening high current circuits. Since arcs generate a great deal of heat energy which is often destructive to the breaker's contacts, it is necessary to limit the duration of the arc and to develop contacts that can withstand the effect of the arc time over time.

A vacuum circuit breaker uses the rapid dielectric recovery and high dielectric strength of the vacuum. The pair of contacts are hermetically sealed in the vacuum envelope. An actuating motion is transmitted through bellows to the movable contact. When the electrodes are parted, an arc is produced and supported by metallic vapor boiled from the electrodes. Vapor particles expand into the vacuum and condense on solid surfaces. At a natural current zero, the vapor particles disappear and the arc is extinguished.

In the past, in association with such wind farms, when collect circuit breakers are opened, the collection circuit voltage would be interrupted and a transient overvoltage situation could occur in the collection circuit. In the overvoltage situation, the high transient voltage in the collection circuit line will "back up" through the circuit and to the electronics associated with the wind energy generators. As a result, this transient overvoltage could cause damage to the circuitry associated with the wind energy generators and other circuitry throughout the system. As a result, in view of the characteristics of the large energy resident within by the overall wind energy farm, there is an extreme need to hold within acceptable limits any overvoltage which occurs when the circuit breaker is be opened.

Typically, to avoid the overvoltage situation, grounding transformers have been required to be installed. These grounding transformers would typically have 34.5 kilovolts on the primary winding with a 600 volts open delta secondary winding. The transformer has a core with windings therearound. In view of the core and windings, there was continuous amount of core losses of energy associated with the use of such grounding transformers. Over time, the core losses could amount to a significant dollar amount of lost energy. Additionally, these grounding transformers had a relatively high initial cost, installation cost, and a long lead time of delivery.

When a single line to ground fault occurs, there are basically two objectives for protecting the collection circuit. The first objective is clearing the fault from the grid to reduce both the incident energy and the time that personnel and equipment are exposed to the huge fault current sourced from the transmission system. When the feeder breaker operates first and clears the plant from the fault, high current from the transmission system is limited in time. However, the temporary overvoltage in the collection circuit can present a problem since the generator is islanding. The second objective is to get the generators to shut down without islanding. This object competes with the first objective of "quickly opening the feeder breaker". It takes approximately 200 milliseconds for the signal to reach the generators in order for them in order to shut the generators down. Islanding occurs when all or a portion of the power generated by power plant becomes electrically isolated from the remainder of the electrical power system. For example, when a collection circuit producing power at 24 megawatts separates, severe islanding can occur. Some designers place a grounding transformer on the collection circuit when trying to avoid temporary overvoltage. In certain cases, however, the grounding transformer will not be effective when it comes to reducing temporary overvoltages and subsequent damage to the lightning arrestors. Grounding transformers connected to the collection circuits provide a zero sequence path to ground that does not provide a positive or negative sequence path to ground. Grounding transformers provide a relatively low zero sequence impedance. However, the impedance is not low enough to prevent a severe voltage rise during a fault followed by a severe islanding event.

Faults in collection circuits happen and the longer that a fault continues, the more damage will because. Although communication systems are fast, they do not process information instantaneously. Therefore, communication plays a very important role in protecting the collection circuit. A signal over a dedicated communication channel, such as a fiber, will take time to complete. This delay is called "latency". Delays from the initiation of a fault on the collection circuit to the time when the equipment is separated or isolated from the fault is called "clearing time". When protecting a collection circuit, among the objectives to be accomplished, it is necessary to clear the fault from the grid and clear the fault from the individual generators. The use of the transfer trip tool can be used. "Transfer trip" means the opening of a circuit breaker from a remote location by means of a signal over a communication channel. When using transfer trip, if the fault is cleared by the grid by tripping the feeder breaker as fast as possible and if the feeder breakers take longer than desired, the entire collection circuit is exposed to temporary overvoltage. If the feeder breaker is intentionally delayed in order to match the opening of the feeder breaker and the wind turbine generator breakers, the feeder is exposed to incident energy (in excess of 15,000 amps) and eventually the temporary overvoltage will occur if the delay is not sufficient.

The Federal Energy Regulatory Commission (FERC) has Reliability Standard PRC-024-1. Relay settings in wind and solar power plants must comply with the standard. The standard states that each generator that has generator voltage protective relaying activated to trip its applicable generating unit(s) shall set its protective relaying such that the generator voltage protective relaying does not trip the applicable generating unit(s) as a result of voltage excursion (at the point of interconnection) caused by an event on the transmission system external to the generating plant that remains within a "no trip zone" of a time duration curve. The point of interconnection means that the transmission (high-voltage) side of the generator step-up transformer or collector circuit transformer. Many types of faults occur within or outside of the wind power or solar power plant. An internal fault is considered as a single line fault to ground while an external fault is a three-phase bolted fault. Conventional ground transformers provide no way for the operator to ascertain whether the fault is internal or external. As a result, operation within the "no trip zone" may be required even though the fault is internal of the wind or solar farm. As such, a need has developed in order for the operator to ascertain whether the fault is internal or external of the wind or solar farm system.

FIG. 1 is an illustration of a prior art system employing a ground transformer. As can be seen, power generators 10, 12, 14 and 16 are connected to respective lines 18, 20, 22 and 24 to a bus 26 via step-up transformer 17, 19, 21 and 23. The bus 26 has a switch 28 located therealong. The grounding transformer 30 is connected forwardly of the switch 28. When switch 28 is opened, as illustrated in FIG. 1, the energy along the bus 26 is passed to the ground transformer 30 and to ground. When the switch 28 is closed, the energy from the bus 26 is passed along another bus 32 for passage to the circuit breaker 34 and then along line 36 to the substation 38. When the grounding transformer 30 is effectively used, any overvoltage is immediately transferred to ground in an acceptable manner. As can be seen in FIG. 1, when the circuit breaker 34 is activated so as to open the circuit, a signal can be passed along line 40 to the switch 28 so as to open the switch 28 and then cause the energy in the bus 26 to pass to the grounding transformer 30.

When grounding transformers are not used, it is necessary to switch the current to ground extremely quickly. If the switch does not occur within a maximum of three cycles, then the overvoltage condition can occur. Ideally, to avoid any potential for an overvoltage situation, it is necessary to close the circuit to ground within one cycle, i.e. 16 milliseconds. Ultimately, experiments attempting to achieve electrical switching systems have indicated that the switching would occur at a level dangerously close to the five cycle limit. Preferably, it is desirable to cause the switching to occur in as close to an instantaneous manner as possible.

In the past, various patents and patent application publications have issued with respect to such circuit breakers. For example, U.S. Pat. No. 5,612,523, issued on Mar. 18, 1997 to Hakamata et al., teaches a vacuum circuit-breaker and electrode assembly. A portion of a highly conductive metal member is infiltrated in voids of a porous high melting point metal member. Both of the metal members are integrally joined to each other. An arc electrode portion is formed of a high melting point area in which the highly conductive metal is infiltrated in voids of the high melting point metal member. A coil electrode portion is formed by hollowing out the interior of a highly conductive metal area composed only of the highly conductive metal and by forming slits thereon. A rod is brazed on the rear surface of the coil electrode portion.

U.S. Pat. No. 6,048,216, issued on Apr. 11, 2000 to Komuro, describes a vacuum circuit breaker having a fixed electrode and a movable electrode. An arc electrode support member serves to support the arc electrode. A coil electrode is contiguous to the arc electrode support member. This vacuum circuit breaker is a highly reliable electrode of high strength which will undergo little change with the lapse of time.

U.S. Pat. No. 6,759,617, issued on Jul. 6, 2004 to S. J. Yoon, describes a vacuum circuit breaker having a plurality of switching mechanisms with movable contacts and stationary contacts for connecting/breaking an electrical circuit between an electric source and an electric load. The actuator unit includes at least one rotary shaft for providing the movable contacts with dynamic power so as to move to positions contacting the stationary contacts or positions separating from the stationary contacts. A supporting frame fixes and supports the switching mechanism units and the actuator unit. A transfer link unit is used to transfer the rotating movement of the rotary shaft to a plurality of vertical movements.

U.S. Pat. No. 7,223,923, issued on May 28, 2007 to Kobayashi et al., provides a vacuum switchgear. This vacuum switchgear includes an electro-conductive outer vacuum container and a plurality of inner containers disposed in the outer vacuum container. The inner containers and the outer container are electrically isolated from each other. One of the inner vacuum containers accommodates a ground switch for keeping the circuit open while the switchgear is opened. A movable electrode is connected to an operating mechanism and a fixed electrode connected to a fixed electrode rod. Another inner vacuum container accommodates a function switch capable of having at least one of the functions of a circuit breaker, a disconnector and a load switch.

U.S. Pat. No. 3,883,706, issued on May 13, 1975 to K. Glaser, describes a multiple rotary wafer type switch with axial bridging contacts and multiple wafer connecting rings. There are at least two circular insulating members each having a central opening. The members are assembled with end faces thereof being in contact and their openings in registry. Radially inwardly extending contact tongues are embedded in the insulating members for cooperation with the rotor having contact bridges arranged in the central openings. An elastically deformable connecting ring is disposed in the central openings and axially overlaps the insulating member.

U.S. Pat. No. 4,016,385, issued on Apr. 5, 1977 to I. Golioto, teaches a high-voltage transfer switch with a cam controlled overlap during transfer. This transfer switch selectively transfers an electrical load from one high-voltage source to another. The transfer switch includes a shaft connected to a handle. There are two circular slotted cams spaced close to opposite ends of the shaft. Cam followers are connected to opposite ends of a follower bar and are inserted in the cam slot. The follower bars connected to the cam follower are connected to vacuum interrupter contacts. The transfer switch is constructed so that as the cam is rotated, the contacts connecting one high-voltage source to the electrical load are closed and as the cam is continued to be rotated, the contactors of the previously connected high-voltage supply are subsequently released.

U.S. Pat. No. 6,462,296, issued on Oct. 8, 2002 to Boettcher et al., describes a circuit breaker arrangement and, in particular, and air-insulated medium-voltage switching arrangement having circuit breaking features, disconnection features and grounding features. The circuit breaker arrangement includes a switching module that is formed from function-oriented modular components. The modular components include abase module component, a pole module component and a drive module component. The base module component is fixedly connected with the drive module component. The pole module component is arranged so as to be movable along a straight line.

U.S. Pat. No. 6,951,993, issued on Oct. 4, 2005 to Kikukawa a et al., provides a vacuum switch having a vacuum container, a grounding switch, and a load switch disposed in a container. An external connection conductor is disposed in the vacuum container and connected electrically inside and outside of the vacuum container. The grounding switch and the external connection conductor are electrically connected to each other in the vacuum container.

U.S. Pat. No. 7,724,489, issued on May 25, 2010 to the present inventor, describes a circuit breaker with a high-speed mechanically-interlocked grounding switch. The subject matter of this patent is described hereinbelow.

U.S. Pat. No. 8,174,812, issued on May 8, 2012 to the present inventor, describes a mechanically interlocked transfer switch that has first, second and third electrical terminals extending outwardly from a housing. A first vacuum bottle is positioned in the housing and has a pair of contactors therein. A second vacuum bottle is positioned in the housing and has a pair of contactors therein. A mechanical linkage is movable between a first position and a second position. The first position electrically connects the first electrical terminal to the second electrical terminal. The second position electrically connects the third electrical terminal to the second electrical terminal. The first vacuum bottle in the second vacuum bottle are longitudinally aligned. The mechanical linkage is interposed between the first and second vacuum bottles.

U.S. Pat. No. 8,467,166, issued on Jun. 18, 2013 to the present inventor, describes a circuit breaker and impedance grounding switch having a first electrical terminal, a second electrical terminal, a third electrical terminal, a first vacuum bottle with a pair of contactors therein, a second vacuum bottle with a pair of contactors therein, and a mechanically interlocked linkage being electrically interconnected to the second electrical terminal and being movable between a first stable position and a second stable position. One of the pair of contactors of the first vacuum bottle is connected to the first electrical terminal. One of the pair of contactors of the second vacuum bottle is electrically interconnected to the third electrical terminal. The linkage has a temporary position between the first and second stable positions electrically connecting simultaneously the first electrical terminal to the second electrical terminal and a third electrical terminal to the second electrical terminal.

Japanese Patent No. 2000341858, published on Dec. 8, 2000, describes a device and method for switching a power supply. This device switches the power supply received by a dual system at high speed by opening the pole of a primary switch at a current zero point formed out of current supplied by primary and secondary power systems. It then turns off the primary switch from a primary power system and steps down the voltage to normal operating voltage. After a pole closing command is sent from a switching control part to the switch of the secondary power system, the pole closing of the switch is completed. A pole opening command is outputted from the switching control part to a primary switch. The pole is open so as to cut off current at a current zero point formed out of currents running from the primary and secondary current systems.

Japanese Patent No. 05174676, published on Jun. 26, 2000, teaches a power source change-over switch which simultaneously carries out change-over switching for selectively switching first and second power sources to connect them to the load. A first contact is provided between a first power source and a load. A second contact is switched complementarity to the first contact and is provided between the second power source and the load. The first contact is composed of a contact pair of a first fixed contact and a first moving contact. The second contact is composed of a contact pair of a second fixed contact and a second moving contact.

Japanese Patent No. 07161265, published on Jan. 26, 2004 describes an electrical power switching device that performs space saving without generating arc short-circuiting. A first auxiliary contactor is formed adjacent to a main contactor. A second auxiliary contactor is formed adjacent to a second main contactor when a switching command is given, the first main contactor is opened. Just after the first main contactor is opened and just before the auxiliary contactor is opened, a voltage drop is generated because the first current control element is inserted between the first power supply and the load.

Japanese Patent No. 2006019193, published on Jan. 19, 2006, describes a switching device that improves the insulation properties of the switching device to which a number of vacuum valves are connected serially. The device has a pair of contacts which are freely connected or disconnected. Two or more serially connected vacuum valves having an arc shield of intermediate potential is enclosed around the pair of contacts. Voltage share elements are connected in parallel between a contactor, the vacuum valve and the arc shield. An operating mechanism is provided for opening and closing the vacuum valve simultaneously.

Japanese Patent No. 11162303, published on Jun. 18, 1999, describes a switchgear intended to reduce the size of the switchgear. A fixed electrode for a main circuit is provided at one end of the inside of one vacuum ground vessel while a fixed electrode for a ground circuit is provided at the other end thereof. The number of each of the electrodes corresponds to the style of a single phase or multiphase system. A moving conductor connected to a load side conductor for each phase is insulation-supported between the fixed electrodes so that it can move linearly. A movable electrode for the main circuit is provided at one end of the moving conductor while the movable electrode for the ground circuit is provided at the other end thereof. A driver for moving the moving conductor is provided at the other side of the vacuum ground vessel.

European Patent Application No. 1 538 650, published on Jun. 8, 2005, teaches an isolator/circuit breaker device for electric substations. The device comprises a casing, at least one circuit breaker, at least one line isolator having a fixed isolator contact, a line isolator actuating shaft for actuating the line isolator, at least one earthing isolator, a circuit breaker actuating shaft for actuating at least one circuit breaker, and a lever connected to a conductor rod cooperating with movable circuit breaker contacts. The conductor rod engages with the fixed isolator contact in a closing position. The device further includes a resilient member cooperating with the conductor rod in order to transfer correct pressing loads to the movable contacts.

An important prior art reference is that of U.S. Pat. No. 7,724,489 to the present inventor. This patent describes a circuit breaker with a high-speed mechanically-interlocked grounding switch. This system 42 is shown in FIG. 2. The circuit breaker system 42 includes a circuit breaker apparatus used for transferring energy upon the opening of the circuit to ground 46. A plurality of wind energy generators 48, 50, 52 and 54 are connected by respective conductors 56, 58, 60 and 62 to a bus 64. The wind energy generators 48, 50, 52 and 54 can be a portion of a wind farm.

As such, various busses 64 can also be connected to a main energy transfer bus 66. Ultimately, the energy is transmitted along line 68 to the circuit breaker 44. When the circuit breaker 44 is suitably closed, then the energy will be delivered along line 70 to substation 72. It can be seen in FIG. 2 that the bus 64 does not include the grounding transformer 30 of the prior art. As such, it is the goal of the circuit breaker 44 to switch the energy to ground 46 as quickly as possible, preferably, within one cycle (i.e., within 16 milliseconds).

FIG. 3 shows the circuit breaker 44 of this prior art document. Circuit breaker 44 includes a housing 74 having a weatherproof roof 76 extending thereover. A first bushing 78 and a second bushing 80 extend outwardly of the housing 74 and through the roof 76. Bushing 78 will extend to the wind farm side of the circuit. Bushing 80 will extend to the substation side of the circuit. A first current transformer 82 is positioned over the bushing 78. The current transformer 82 is a doughnut-shaped transformer which serves to detect the amount of current passing through the first bushing 78. As such, the current transformer 82 serves to monitor the power and the quality of the power passing through bushing 78. The current transformer 82 can be electrically interconnected to a suitable relay for opening and closing the circuit breaker in the event of the detection of a problem with the power transmission or other requirements of the opening or closing of the circuit breaker.

The bushing 80 has another current transformer 84 extending therearound. Current transformer 84 is a configuration similar to that of current transformer 82. Current transformer 84 serves to sense the power and the quality of power passing outwardly of the circuit breaker 44 and to the substation. Once again, the current transformer 84 can be suitably interconnected to proper relays so as to open and close the circuit breaker 44 in the event of a problem condition.

A busbar 86 connects the bushing 78 to the mechanical interlock 88. The mechanical interlock 88 is interposed between a first vacuum bottle 90 and a second vacuum bottle 92. Another busbar 94 is located at the top of the first vacuum bottle 90 and extends in electrical connection to the second bushing 80. The second vacuum bottle 92 includes a grounding bar 96 suitably connected to ground. Supports 98, 100 and 102 will maintain the vacuum bottles 90 and 92, along with the mechanical interlock 88, in a longitudinally-aligned orientation extending substantially vertically within the interior of the housing 74. A suitable operating and communication mechanism 104 is cooperative with the mechanical interlock 88. Control push buttons and indicating lamps 106 are located on a wall of the enclosure 74 so as to provide a humanly perceivable indication of the operation of the circuit breaker 44 and allowing for manual control of the mechanical interlock 88. There is an auxiliary terminal block compartment 108 located on an opposite wall of the enclosure 74 from the control push buttons 106. The housing 74 is supported above the earth by legs 110 (or by other means).

FIG. 4 shows a frontal view of the housing 74 of the circuit breaker 44. Importantly, in FIG. 4, it can be seen that the bushing 78 actually includes a first bushing 112, a second bushing 114 and a third bushing 116 extending outwardly of the roof 76 of housing 74. The bushings 112, 114 and 116 will correspond to the three phases of current passing as energy from the wind farm. Similarly, the second bushing 80 will also have an array of three of such bushings such that the three phases can be passed from the circuit breaker. A door 118 is mounted on the housing 74 so as to allow easy access to the interior of the housing 74. Legs 110 serve to support the housing 74 above the earth.

FIG. 5 illustrates the operation of the mechanical interlock 88. As can be seen, the mechanical interlock 88 includes an actuator arm 120 which extends between the first vacuum bottle 90 and the second vacuum bottle 92. The busbar 86 is electrically interconnected to the actuator arm 120. The first vacuum bottle 90 is hermetically sealed in a vacuum condition. The first vacuum bottle 90 includes a first contactor 122 and a second contactor 124 within the interior of the vacuum bottle 90. The first contactor 122 is connected by conductor 126 in electrical interconnection to the second bushing 80. The second vacuum bottle 92 includes a first contactor 128 and a second contactor 130. The second contactor 130 is connected by conductor 132 to ground 46.

In FIG. 5, the actuator arm 120 is in its first position. In this position, the contactors 122 and 124 are juxtaposed together so as to be in electrical connection. As such, power passing along busbar 86 will be transmitted through the interior of the first vacuum bottle 90 through conductor 126 to the bushing 80. The circuit to ground through the second vacuum bottle 92 is open. As such, FIG. 5 illustrates the normal operating condition of the circuit breaker 44 of the present invention in which the power is passed directly therethrough to the substation 72.

In the event of an interruption, a failure, or a problem, the circuit breaker 44 will open the circuit to the substation so that the electrical energy passing through the busbar 86 is passed to ground 46 instantaneously. As can be seen in FIG. 6, the first contactor 122 is electrically isolated from the second contactor 124 within the interior of vacuum bottle 90. As such, the conductor 126 is electrically isolated from power passing from the busbar 86. The actuator arm 120 instantaneously separates the contactor 124 from the contactor 122 while, at the same time, establishes an electrical connection between the contactor 128 and the contactor 130 in the second vacuum bottle 92. As such, the power from the busbar 86 is immediately switched to ground 46.

It was found that the system of U.S. Pat. No. 7,724,489 was an extremely effective circuit breaker for use in wind or solar farm applications. The subject matter of U.S. Pat. No. 7,724,489 has been widely employed throughout the world in connection with wind farms. However, it was found that certain improvements can be made in the circuit breaker of U.S. Pat. No. 7,724,489 which allow the circuit breaker to achieve unique advantages and benefits.

Initially, the circuit breaker apparatus utilizes a very large enclosure. This large enclosure is required because of the longitudinal alignment of the vacuum bottles of the main circuit breaker and the grounding switch as well as separation between the three phases of the electrical system. As such, the enclosure which contains these vacuum bottles needs to have a significant height to accommodate this longitudinal alignment as well as a significant width to separate the three phases adequately. It was necessary to maintain this longitudinal alignment in order to avoid possible arcing events that could occur between the main circuit breaker and the grounding switch. Additionally, in view of the relatively tall configuration of the circuit breaker, it was necessary to extend the bushings outwardly of the top of the enclosure. These bushings would be connected to switch disconnects located thereabove and to the main bus located thereabove. As such, the installation of the circuit breaker of U.S. Pat. No. 7,724,489 had a significant height. As such, need developed so as to reduce the size of the circuit breaker apparatus.

It is an object of the present invention to provide a circuit breaker apparatus that has a relatively small housing and a small footprint.

It is another object of the present invention to provide a circuit breaker apparatus that is easier to transport and assemble.

It is a further object of the present invention to provide a circuit breaker apparatus that has the ability to differentiate between internal faults and external faults.

It is a further object of the present invention to provide a circuit breaker apparatus which can avoid the need to address certain no-trip zones.

It is a further object of the present invention to provide a circuit breaker apparatus that avoids islanding events.

It is another object of the present invention to provide a circuit breaker apparatus that eliminates concerns regarding cybersecurity.

It is a further object of the present invention to provide a circuit breaker apparatus that has better safety and reliability.

It is still another object of the present invention to provide a circuit breaker apparatus that eliminates temporary overvoltages.

These and other objects and advantages of the present invention will become apparent from a reading of the attached specification and appended claims.

BRIEF SUMMARY OF THE INVENTION

The circuit breaker apparatus of the present invention comprises a housing, and electrical power inlet, an electrical power outlet, a main circuit breaker, a grounding switch, and a mechanical linkage. The main circuit breaker is positioned in the housing. The main circuit breaker has a pair of contactors therein. One of the pair of contactors is electrically connected or interconnected to the electrical power inlet and to the electrical power outlet. The grounding switch is also positioned in the housing. The grounding switch has a pair of contactors therein. One of the pair of contactors of the grounding switch is electrically connected or interconnected to ground. The grounding switch is in a non-longitudinal relation to the main circuit breaker. The mechanical linkage is movable between a first position and a second position. The first position actuates the main circuit breaker such that the pair of contactors of the main circuit breaker are closed and such that pair of contactors of the grounding switch are opened. The mechanical linkage is movable to a second position so as to actuate the main circuit breaker such that the pair of contactors of the main circuit breaker open and such that the pair of contactors of the grounding switch are closed.

In the preferred embodiment of the present invention, the housing has an interior that is filled with air.

The electrical power outlet has a main bus having at least a portion positioned in the housing. The main circuit breaker is electrically connected to the main bus when the pair of contacts of the main circuit breaker are closed. A switch disconnect is also positioned in the housing. The switch disconnect is movable between a first position which electrically connects the main circuit breaker to the main bus and a second position electrically isolating the main circuit breaker from the main bus. The grounding switch extends in generally transverse relationship to the main circuit breaker.

The mechanical linkage includes an actuator that is movable between a first position that a second position. The actuator is movable from the first position to the second position upon detection of a fault in electrical power from the electrical power inlet. A yoke is connected to the actuator. The yoke is connected to one of the pair of contactors of the main circuit breaker and one of the pair of contactors of the grounding switch. A movement of the actuator to the second position causes the pair of contactors of the main circuit breaker to open and the pair of contactors of the grounding switch to close. The yoke is pivotally mounted within the housing. The yoke has a generally L-shape. The actuator has an arm connected to one end of the L-shape of the yoke. One of the pair of contactors of the grounding switch is connected to a portion of the L-shape away from the one end of the L-shape. One of the pair of contactors of the main circuit breaker is connected to an opposite end of the L-shape. The actuator has a rod connected to the arm in a location away from one end of the L-shape. The rod is resiliently mounted so as to move downwardly upon a detection of a fault in the electrical power from the electrical power inlet. The downward movement causes the rod to move the arm so as to pivot the yoke in order to open the pair of contactors of the main circuit breaker and close the pair of contactors of the grounding switch.

The main circuit breaker has a vacuum bottle in which the pair of contactors are positioned. The grounding switch also has another vacuum bottle in which the pair of contactors are positioned.

The electrical power inlet includes a cable extending to or into the housing, a conductor connected to the cable through a bushing, and a conductive plate positioned in the housing adjacent to the main circuit breaker. The main circuit breaker is electrically connected to the conductive plate.

A grounding bus is connected to another of the pair of contactors of the grounding switch. The grounding bus is connected to the ground so that the electrical power passes to ground when the pair of contactors of the main circuit breaker open and when the pair of contactors of the grounding switch are closed. One of the pair of contactors the main circuit breaker is movable while another of the pair of contactors of the main circuit breaker is fixed. One of the pair of contactors of the grounding switch is movable while another of the pair of contactors of the grounding switch is fixed.

In the present invention, the electrical power inlet passes power of three phases. The main circuit breaker comprises three main circuit breakers respectively connected to the three phases. The grounding switch is respectively connected to the three phases. The mechanical linkage comprises three mechanical linkages respectively connected to the three main circuit breakers and the three grounding switches.

The housing has a gas release valve affixed thereto. The gas release valve is movable between an open position and a closed position. The gas release valve is movable to the open position when an arc or an explosion occurs within the housing. The housing has an enclosed channel cooperative with the gas release valve so as to conduct hot gas outwardly when said gas release valve is in the open position.

The present invention is also a switchgear having a plurality of the circuit breakers connected together. The electrical power outlet is a main bus that extends between the plurality of circuit breaker apparatuses.

This foregoing Section is intended to describe, with particularity, the preferred embodiments of the present invention. It is understood that modifications to these preferred embodiments can be made within the scope of the present claims. As such, this Section should not to be construed, in any way, as limiting of the broad scope of the present invention. The present invention should only be limited by the following claims and their legal equivalents.

DETAILED DESCRIPTION OF THE INVENTION

Figure 1:
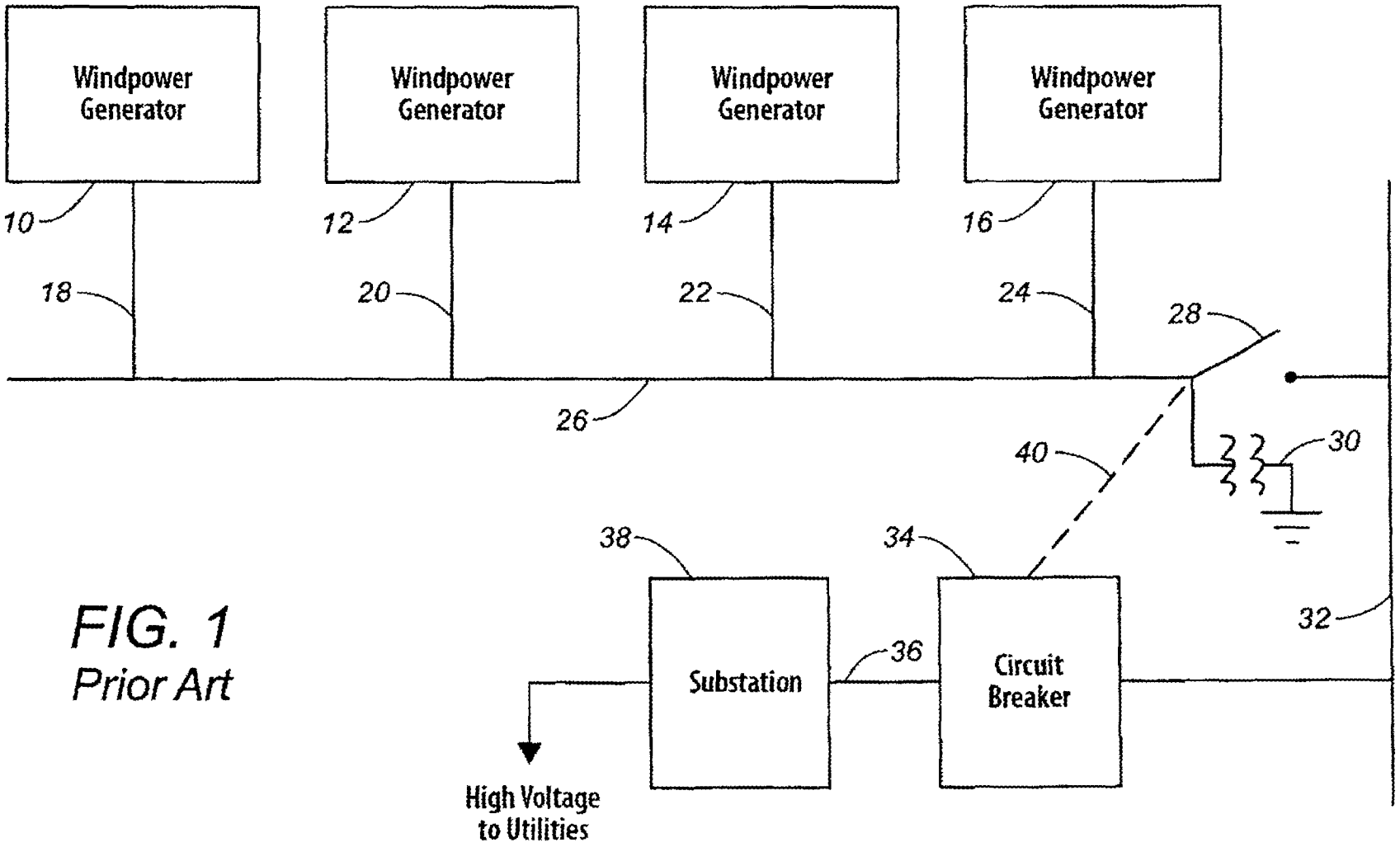
FIG. 1 Prior Art
FIG. 1 is a block diagram showing the operation of a prior art circuit breaker system.
Figure 2:
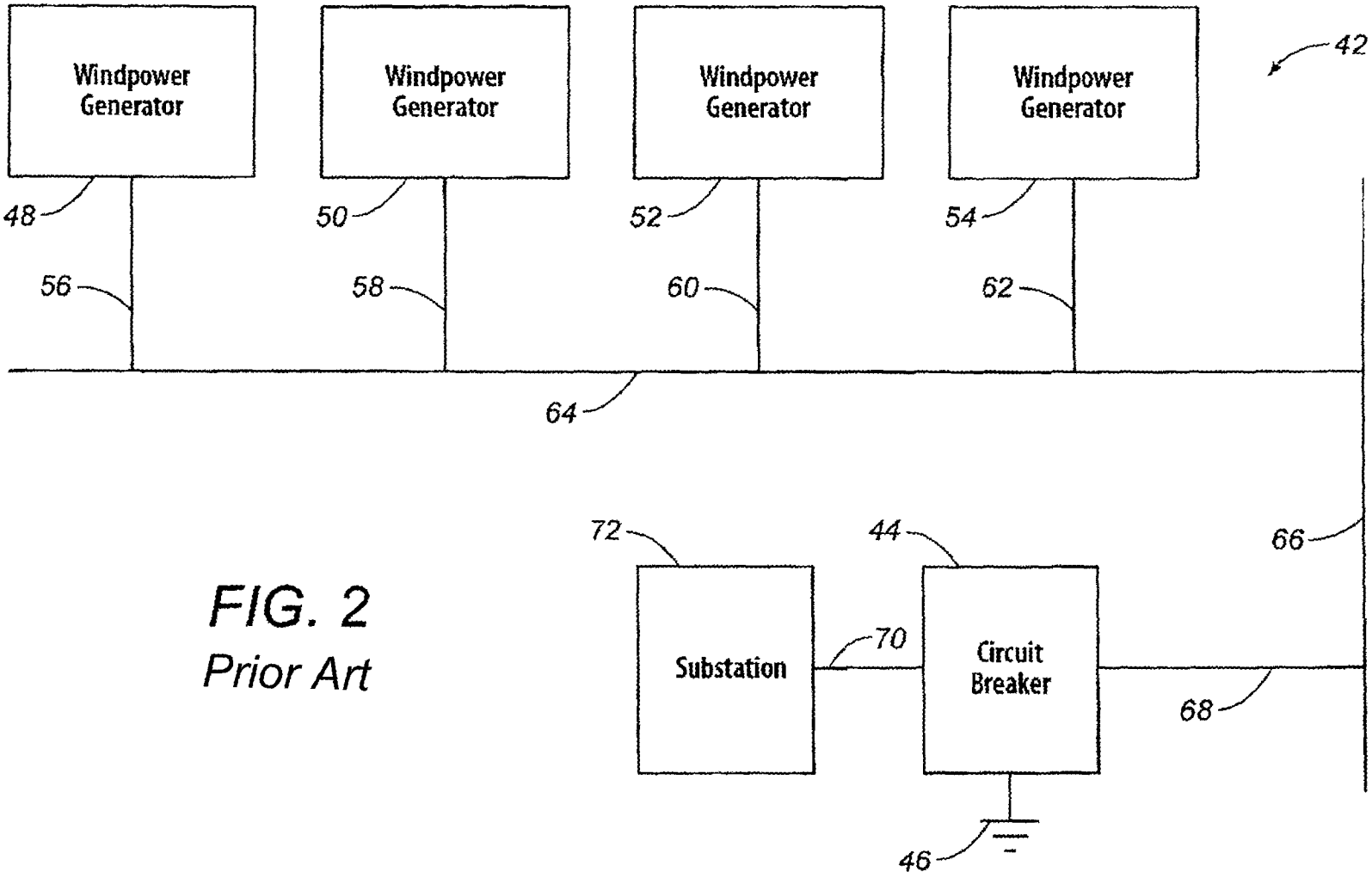
FIG. 2 Prior Art
FIG. 2 is a block diagram showing the prior art circuit breaker system of U.S. Pat. No. 7,724,489.
Figure 4:
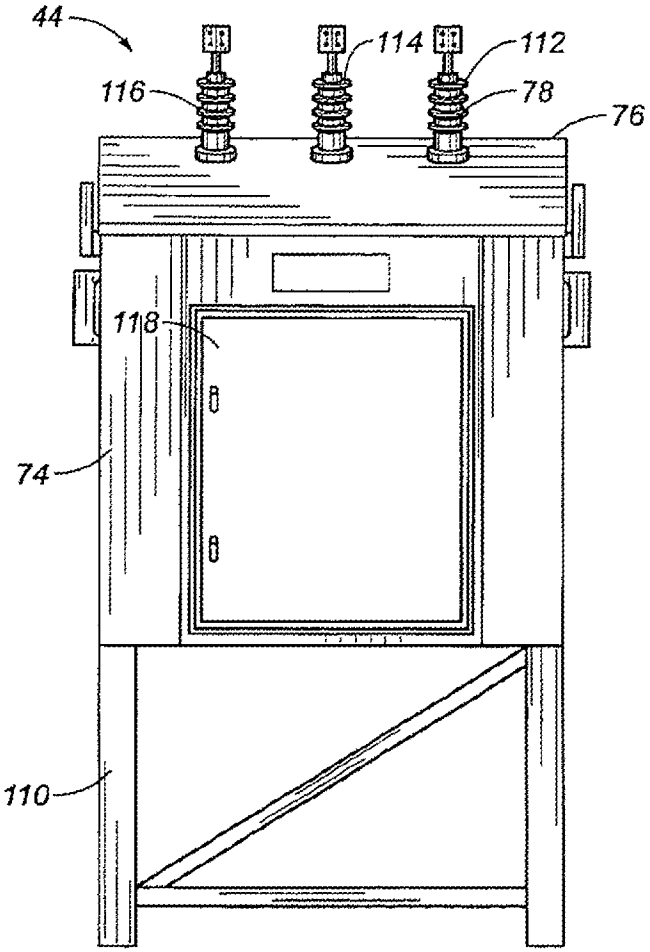
FIG. 4 Prior Art
FIG. 4 is a frontal elevational view of the circuit breaker of the prior art of U.S. Pat. No. 7,724,489.
Figure 3:
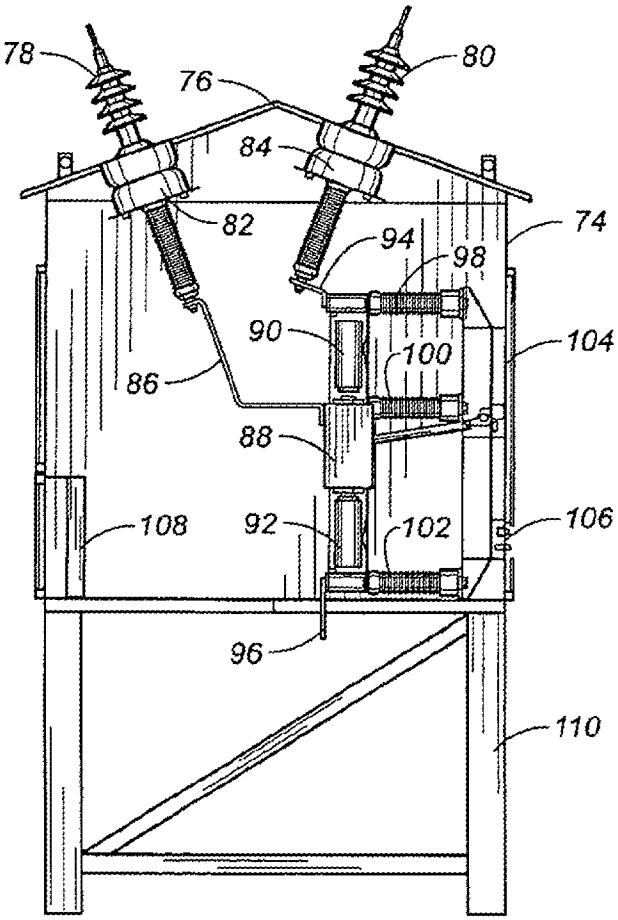
FIG. 3 Prior Art
FIG. 3 is a side interior view of the circuit breaker of the prior art in accordance with U.S. Pat. No. 7,724,489.
Figure 6:
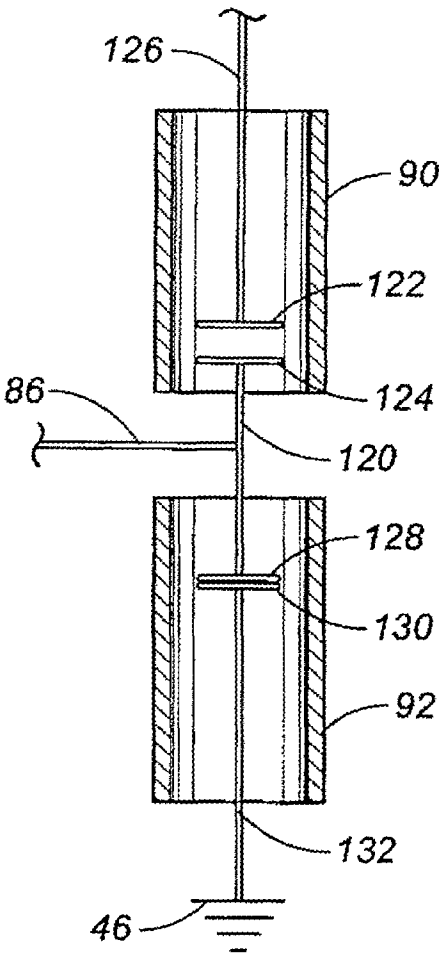
FIG. 6 Prior Art
FIG. 6 is an illustration of the operation of the mechanical interlock of the prior art of U.S. Pat. No. 7,724,489 with the mechanical interlock in a second position.
Figure 5:
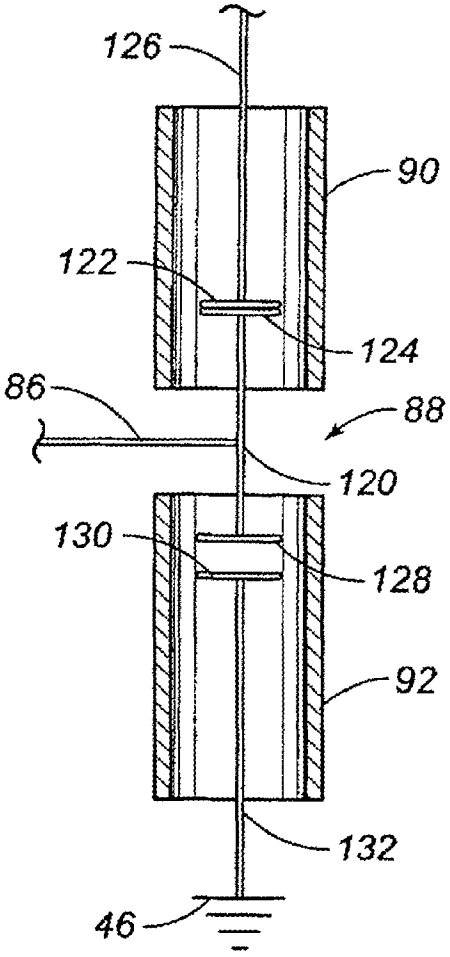
FIG. 5 Prior Art
FIG. 5 is an illustration of the mechanical interlock of the prior art of U.S. Pat. No. 7,724,489 in a first position.
Figure 7:
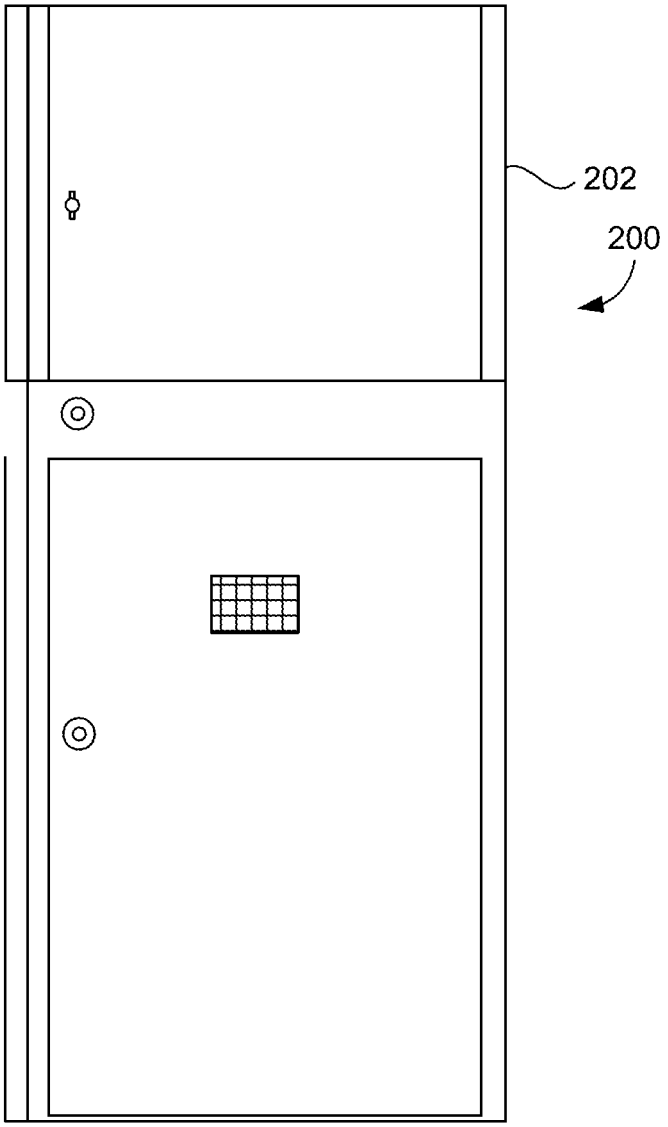
FIG. 7 is a frontal elevational view of the circuit breaker apparatus of the present invention.

Referring to FIG. 7, there is shown the circuit breaker apparatus 200 in accordance with the present invention. The circuit breaker apparatus 200 includes a housing 202 in which the components are contained. Suitable sensors are provided in the housing 202 so that when a fault occurs in the electrical power inlet, the actuating mechanism is actuated so as to break the circuit and to prevent power from flowing between the electrical power inlet and the electrical power outlet.

Figure 8:
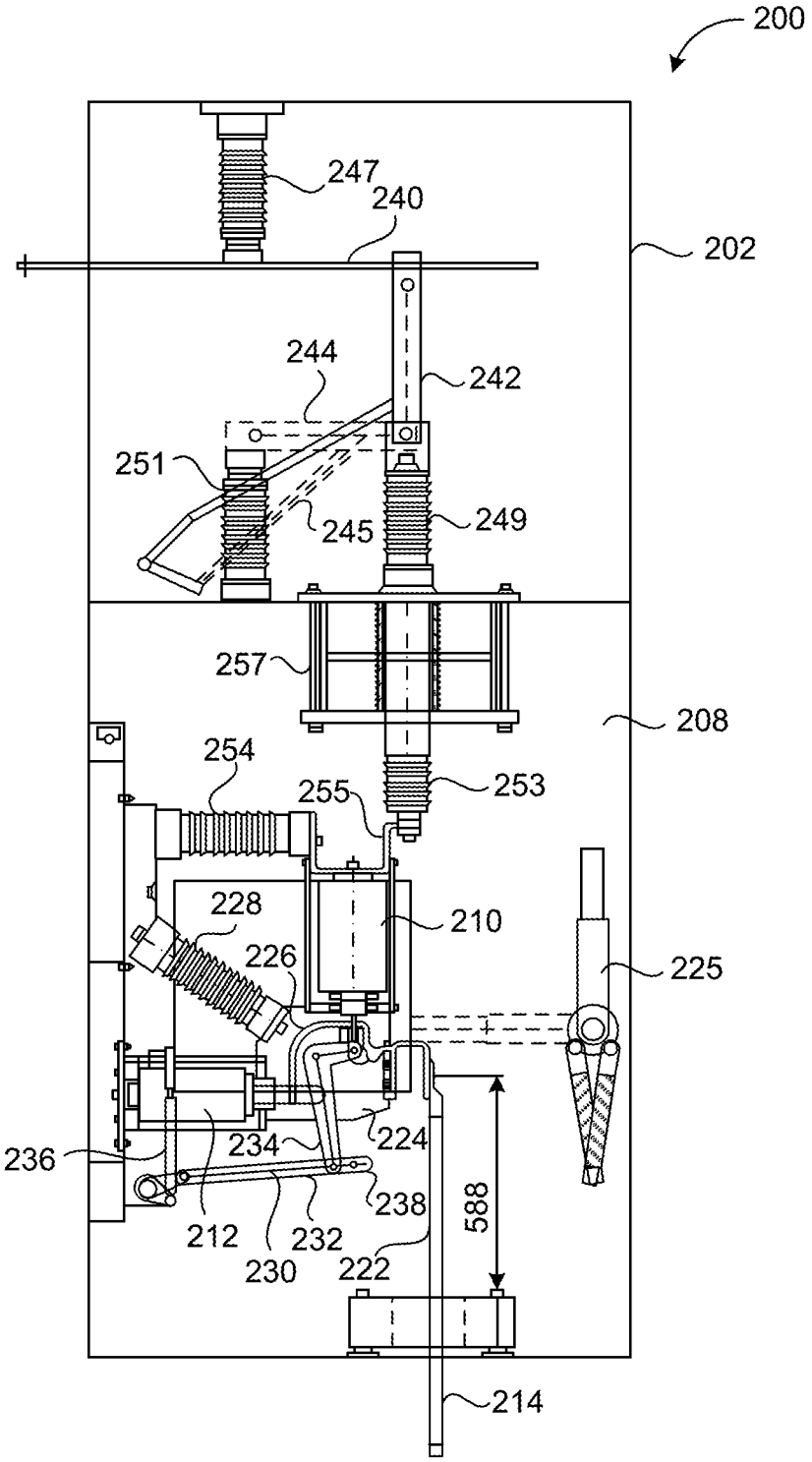
FIG. 8 is an interior frontal view of the circuit breaker apparatus of the present invention.

FIG. 8 shows an interior view of the housing 202 of the circuit breaker apparatus 200. Importantly, in the circuit breaker apparatus of the present invention, there is an interior 208 which is generally sealed. The interior 208 will be filled with air. Air is the proper gas to use for onshore wind farms since rust and size and are not of concern for such onshore wind farms. The use of air, instead of an isolating gas, allows the manufacturing cost of the circuit breaker apparatus 200 to be much lower. As such, the circuit breaker apparatus 200 will have a reduced cost of the users.

In FIG. 8, it can be seen that the main circuit breaker 210 and the grounding switch 212 are in non-longitudinal, non-linear relationship. In particular, the main circuit breaker 210 is in generally transverse relationship to the grounding switch 212. The distances between the main circuit breaker 210 and the grounding switch 212 would assure that there is no arcing events between these components.

FIG. 8 shows the electrical power inlet 214. Electrical power inlet can be divided into three separate phases. The three phases will be placed in generally close alignment. The size of the housing 202 and the air within the housing 202 ensures that there is no arcing between the phases. An input power cable 222 extends from the electrical power inlet 214. The input power cable 222 is in electrical connection with a conductive plate 224. Conductive plate 224, in the preferred embodiment, is an aluminum plate. A copper flexible foil 226 is in electrical connection with the conductive plate 224 and also an electrical connection with the main circuit breaker 210 and the grounding switch 212. An insulated support 228 serves to secure the conductive plate 224 in a proper position within the interior 208 of the housing 202. A mechanical linkage 230, as will be described hereinafter, is movable between a first position and a second position. The first position actuates the main circuit breaker such that the pair of contactors in the main circuit breaker are closed and such that the pair of contactors of the grounding switch 212 are open. The mechanical linkage 230 is also movable to a second position so as to actuate the main circuit breaker such that the pair of contactors of the main circuit breaker 210 are open and such that the pair of contactors of the grounding switch to 212 are closed. A manual grounding switch 225 serves to short circuit and ground the input power cable 222 for electrical safety purposes.

The mechanical linkage 230 includes an actuator 232 that is movable between a first position and a second position. The actuator 232 is movable from the first position to the second position upon detection of a fault in the electrical power from the electrical power inlet 214. A yoke 234 is pivotally mounted within the interior 208 of housing 202. The yoke is connected to one of the pair of contactors of main circuit breaker 210 and one of the contactors of the grounding switch 212. A movement of the actuator 232 to the second position causes the pair of contactors of the main circuit breaker 210 to open and the pair of contactors of the grounding switch 212 to close.

It can be seen that the yoke 234 has a generally L-shape. The actuator 232 is connected adjacent to one end of the L-shape of the yoke 234. One of the pair of contactors of the grounding switch is connected to a portion of the L-shape away from one end of the L-shape. One of the pair of contactors of the main circuit breaker 210 are connected to an opposite end of the L-shape. The actuator 232 includes a rod 236 that is connected to the arm 238 at a location from one end of the L-shape of the yoke 234. The rod 236 is resiliently mounted so as to move downwardly upon the detection of a fault in the electrical power from the electrical power inlet 214. The downward movement of the rod 236 causes the rod 236 to move the arm 238 in order to pivot the yoke 234 in order to open the pair of contactors of the main circuit breaker 210 and to close the pair of contactors of the grounding switch 212.

The main circuit breaker 210 has a vacuum bottle in which the pair of contactors are positioned. Similarly, the grounding switch 212 has another vacuum bottle in which the pair of contactors of the grounding switch are positioned.

A main bus 240 is located in an upper portion of the housing 202. An isolator, namely switch disconnect 242, is cooperative with the main bus 240. The main bus 240 has at least a portion positioned within the housing 202. This main bus can extend outwardly of the housing 202 so as to connect with other circuit breaker apparatus, such as circuit breaker apparatus 200. As such, it can be used to form a suitable switchgear (as will be shown in FIG. 13).

The main circuit breaker 210 is electrically connected to the main bus 240 when the pair of contactors of the main circuit breaker 210 are closed. The switch disconnect 242 is positioned in the housing 202. The switch disconnect is movable between a first position in which the main circuit breaker 210 is electrically connected to the main bus 240 and a second position in which the main bus 240 is electrically isolated from the main circuit breaker 210. In particular, there is a contact blade 244 that is connected to a linkage 245 so as to be mechanically or manually operated so as to move the switch disconnect 242 between the first position and the second position. A movement of the contact blade 244 and the linkage 245 in one direction will separate the switch disconnect 242 so that the switch disconnect 242 is in the second position. The contact blade 244 and the linkage 245 can be rotated or manipulated in an opposite directions so as to urge the switch disconnect 242 upwardly so as to electrically connect with the main bus 240.

An insulated support 247 retains the main bus 240 in a proper horizontal orientation within the interior 208 of the housing 202. Another insulated support 249 maintains the switch disconnect 242 in a proper position in the interior 208 of the housing 202. Another insulated support 251 supports the contact blade 244 (along with the linkage 245) within the housing 202. Insulated support 253 supports the conductor 255 that is connected to the main circuit breaker 210. Insulated supports 249 and 253 extend over the bus that extends from the main circuit breaker 210 to the switch disconnect 242 and the main bus 240. A frame 257 is positioned within the interior 208 of the housing 202 so as to structurally support current transformers for relaying and metering purposes. Another insulated support 259 extends inwardly from a wall of the housing 202 so as to support an end of the conductor 255 and to support the main circuit breaker 210 within the housing 202.

Figure 9:
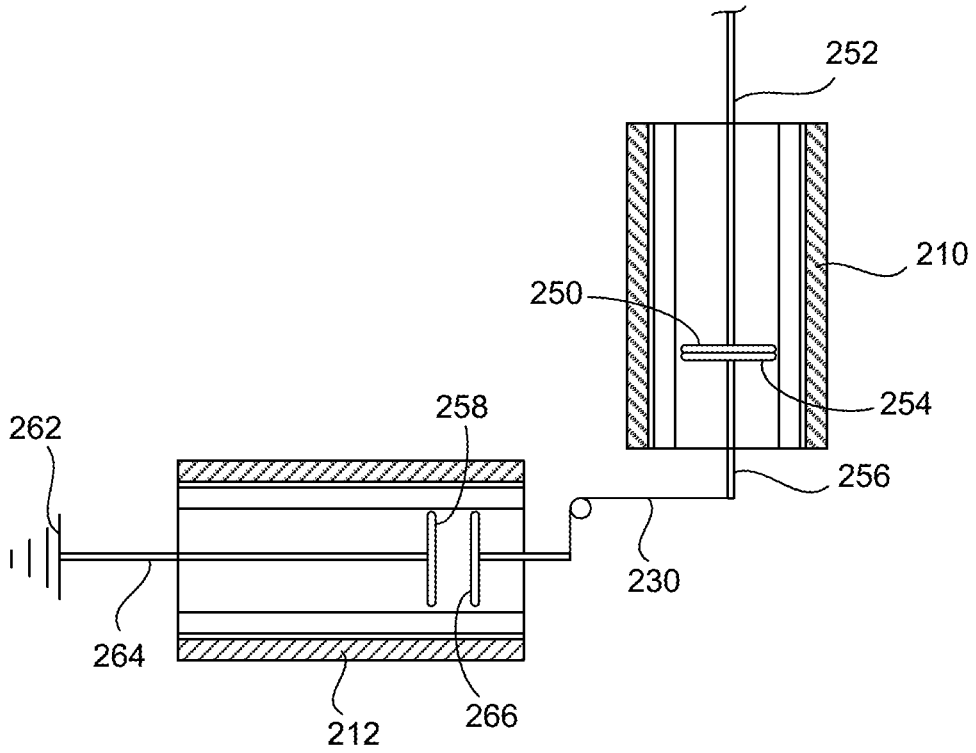
FIG. 9 is a cross-sectional and diagrammatic view showing the mechanical linkage in a first position.

FIG. 9 shows the specific operation of the mechanical linkage 230 relative to the main circuit breaker 210 and the grounding switch 212. It can be seen that the main circuit breaker 210 has a contactor 250 that is in a fixed position and is connected to a line 252. There is a second contactor 254 which is movable. In FIG. 9, the second contactor 254 contacts with the first contactor 250 so that an electrical connection is established between the line 256 and line 252. In this configuration, electrical power from the electrical power inlet 214 can flow to the main bus 240 (assuming the switch disconnect 242 is closed). When the pair of contactors 250 and 254 of the main circuit breaker 210 are closed, the mechanical linkage 230 automatically serves to keep open the contactors 258 and 260 of the grounding switch 212. As such, power from the electrical power inlet 214 will not flow to ground 262. It can be seen that the main circuit breaker 210 is in transverse relationship to the grounding switch 212.

Figure 10:
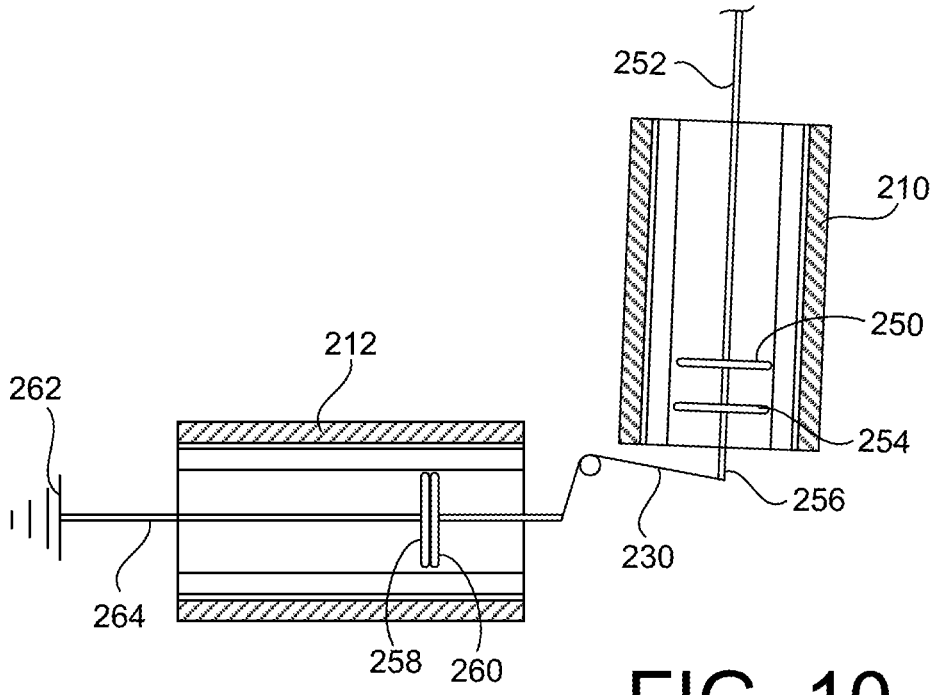
FIG. 10 is a cross-sectional and diagrammatic view of the mechanical linkage and a second position.

FIG. 10 shows what happens when there is a pivoting of the mechanical linkage 230 which is caused by a fault in the electrical power from the electrical power inlet 214. In this arrangement, the first contactor 250 of the main grounding switch 210 is opened relative to the second contactor 254. As such, current will not flow from line 256 to line 252. Simultaneously, the contactor 260 is closed upon contactor 258 of the grounding switch 212. As such, upon a fault in the electrical power from the electrical power inlet 214, the power will flow to ground 262 through line 264. In this configuration, the present invention assures that the transfer of power to ground and the disconnection of power to the main bus is automatic, immediate and simultaneous upon the detection of a fault.

Figure 11:
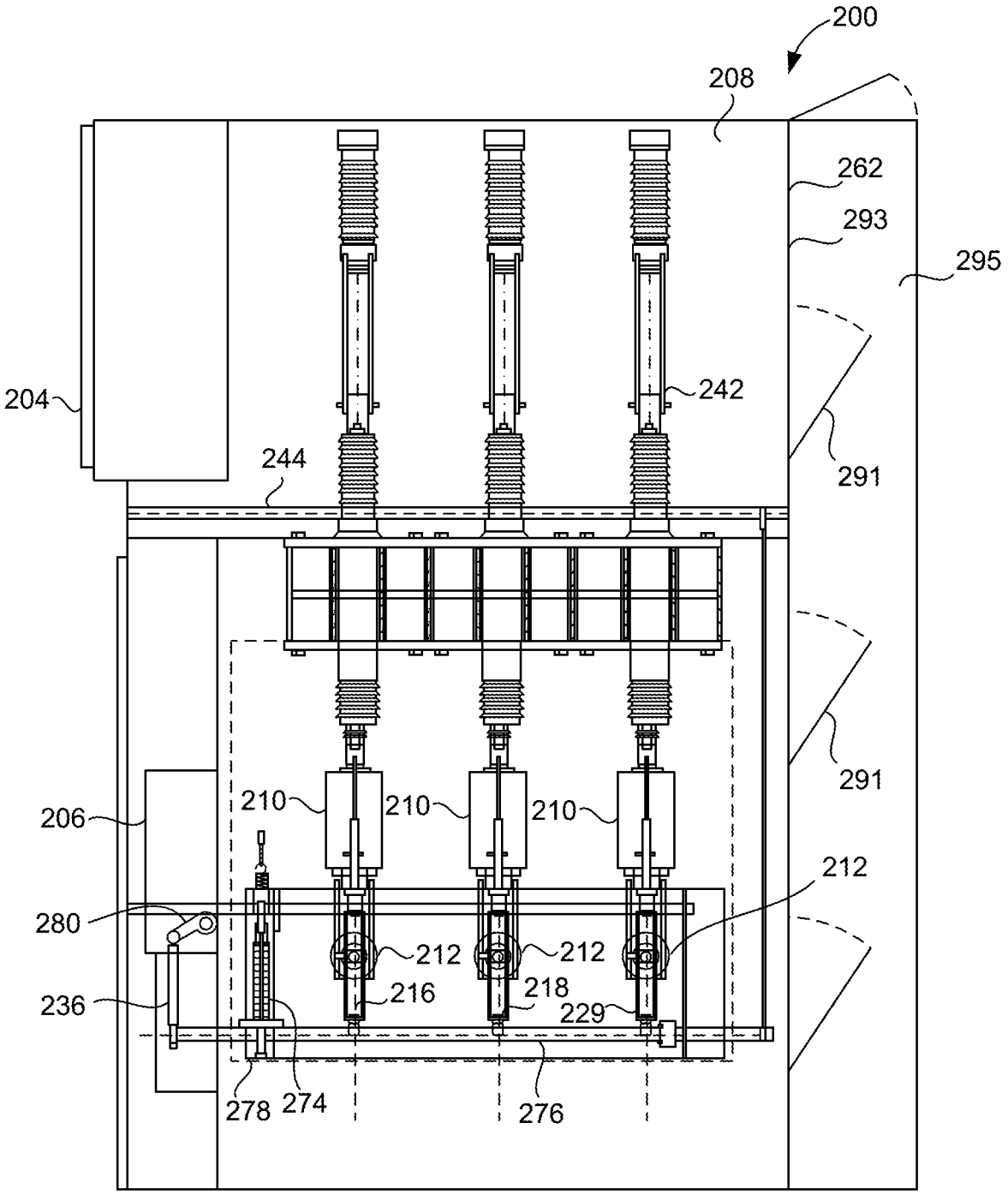
FIG. 11 is a interior side view of the circuit breaker apparatus of the present invention.

FIG. 11 shows the circuit breaker apparatus 200 of the present invention as used in association with the three phases of power. Initially, the power supply from a wind or solar farm can be connected to the electrical power inlet. The electrical power inlet is then divided into the separate phases 216, 218 and 220. Each of the separate phases 216, 218 and 220 is directed to the separate main circuit breakers 210 and separate grounding switches 212. A shock absorber 274 is connected to one end of a shaft 276. Shaft 276 is part of the mechanical linkage 230 and, in particular, acts on arm 238 (as shown in FIG. 8). The shaft 276 will extend through a bushing 278 and into the actuating mechanism 230. The actuating mechanism has a rod 236 extending downwardly so as to act on and rotate the shaft 276. As such, a small cam 280 located in the controller 206 moves the rod 236 downwardly so as to rotate the shaft 276 in order to move the arm 238 and thereby move the yoke 234 between the first and second positions (in the manner described herein previously). The shaft 244 associated with the switch disconnect 242 can be rotated manually or electromechanically through the controller 204. The rotation of the shaft 244 will move the switch disconnect 242 between the first position and the second position.

In FIG. 11, it can be seen that there is a plurality of gas release valves 291 that are affixed to the wall 293 of the housing 202. Gas release valves 291 are movable between a closed position (against the wall 293) and an open position (as shown in FIG. 11). These gas release valves 291 serve to conduct hot gas outwardly of the interior 208 of the enclosure 202 in the event of an arcing event or an explosion. Ultimately, this hot gas will be discharged away from any personnel located near the circuit breaker apparatus 200 by being diverted into an enclosed channel 295. As such, the hot gas can be diverted in a direction away from the operator and can be directed along a channel formed on the switchgear apparatus. The use of the gas release valves greatly improves the safety of the circuit breaker apparatus 200.

Figure 12:
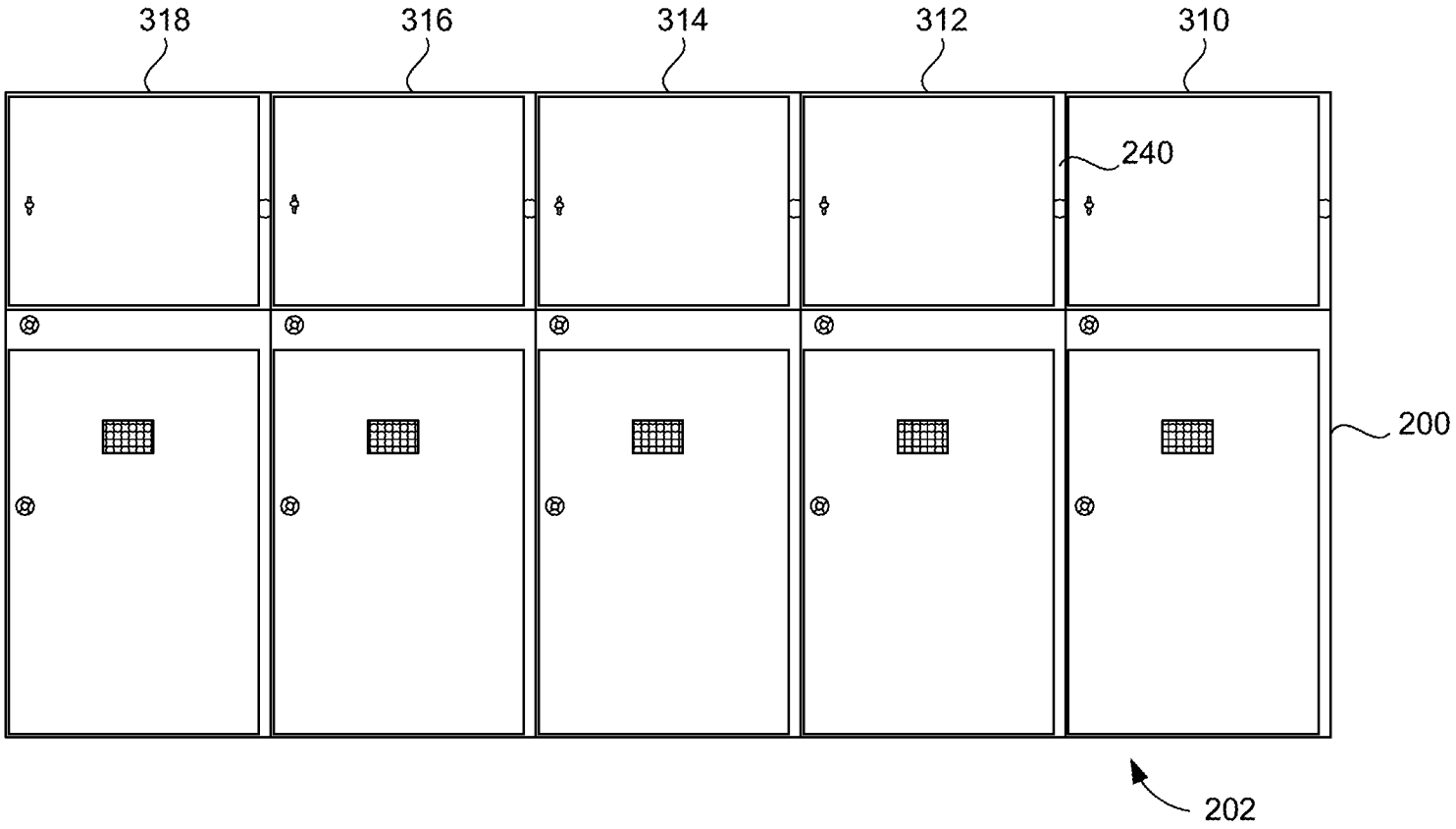
FIG. 12 is a frontal view showing the circuit breaker apparatus of the present invention configured as a switchgear.

FIG. 12 shows the circuit breaker apparatus 200 in the form of switchgear 310. As can be seen the circuit breaker apparatus 200 is joined to another circuit breaker apparatus 312 by way of the main bus 240. Main bus 240 will extend through the interior of the circuit breaker apparatus 312 and eventually into the interior of the circuit breaker apparatus 314. As such, the circuit breaker apparatuses 200, 312, 314, 316 and 318 can operate in unison so as to deliver power to the grid. As such, the housings 202 can be arranged next to one another in a very small footprint and of a very small size.

Unlike the subject matter of U.S. Pat. No. 7,723,489, it is important to note that the switch disconnect 242 and main bus 240 are located within the interior of the housing. As such, the bushings associated with the prior art are avoided in the present invention along with the complex arrangement of the switch disconnects and the main bus at a location above the circuit breaker apparatus. As such, the present invention provides a very compact configuration. This reduces size, transportation costs, manpower required for assembly, materials, along with a variety of other cost savings.

Unlike the subject matter of U.S. Pat. No. 7,724,489, the main circuit breaker 210 and the grounding switch 212 are placed in non-longitudinal alignment and the three phases of power can be placed in close proximity to each other. As such, the height and the width of the housing are greatly reduced and the space required for the operating mechanisms within the housing are also significantly reduced.

Simulation shows that the circuit breaker apparatus of the present invention resolves both issues of temporary overvoltage and incident energy where delays are not needed for clearing the fault from the plant. The present invention completely operates within nearly fifty milliseconds to open, clear the fault, close, and ground the affected collection circuit. As such, it collapses the voltage. When closed to ground, the present invention results in a very low impedance in the cable. There is a very clear change in impedance as it operates. Generators can detect such a change and act on it. The temporary overvoltage duration is minimized by the combination of the fast transition state of the present invention and the lightning arrestors. The present invention significantly lowers the energy burden on lightning arrestors and protects them. The present invention relieves the lightning arrestor and keeps the resulting temporary overvoltage below the duty curves. Without the present invention, the arrestors could be destroyed by other protection schemes. If they are destroyed and not replaced, expensive collection circuit equipment could be damaged thereinafter.

The circuit breaker apparatus the present invention signals the wind generators in a fraction of the 150 ms required by PRC-024-1 and PRC-024-2 when the fault is inside the plant. This provides the generators with valuable information in which to allow the decision to be made to shut down. The present invention signals the generator that the fault is inside the plant and shuts them down for events that the turbines should not ride through. This provides a valuable discriminatory function that standard circuit breakers would not. The present invention forms a three-phase bolted ground and provides a zero reference closer to the generators than the zero reference that forms with the three-phase bolted ground at the point of interconnection. The difference in impedance between internal faults and external faults is basically the impedance of the main plant transformer. At near full power for the wind or solar power plant, the delta in voltage between the two fault locations is approximately eight percent. As a result, each generator can detect and discriminate between each fault location. Because the present invention can help differentiate between internal and external faults, generators will know via, the voltage measured at their terminals, that the fault is outside the plant and keep it running. As a result, the present invention provides designers and engineers with the ability to distinguish between external and internal faults. As such, the generators may be set to trip if the fault is in the plant or ride through the fault if the fault is outside the plant. The present invention does not require the use of fiberoptic installations that link the substation with the turbines to send shutdown signals to the generator. As such, the present invention is extremely cybersecure. The shutdown signal goes from the present invention to all of the generators of the collection circuit faster than any other means and the signal is transmitted to all of the generators at the same time.

The present invention protects solar/wind power plants by reducing incident energy and eliminating temporary overvoltage. Elimination of the temporary overvoltage is an important feature of the present invention. Through the present invention, the lightning arrestors are operated below their prior duty curve, insulation coordination of the feeder circuit is maintained, and the equipment becomes more reliable. The present invention has an anti-island functionality. Unlike the prior art, the present invention avoids the islanding effect.

The foregoing disclosure and description of the present invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A circuit breaker apparatus comprising:

a housing having a interior filled with air;

an electrical power inlet;

an electrical power outlet;

a main circuit breaker positioned in said housing, said main circuit breaker having a pair of contactors therein, one of said pair of contactors electrically connected or interconnected to said electrical power inlet and to said electrical power outlet;

a grounding switch positioned in said housing, said grounding switch having a pair of contactors therein, one of said pair of contactors of said grounding switch being electrically connected or interconnected to ground, said grounding switch being in non-longitudinal relation to said main circuit breaker; and a mechanical linkage movable between a first position and a second position, said first position actuating said main circuit breaker such that the pair of contactors of said main circuit breaker are closed and such that the pair of contactors of said grounding switch are open, said mechanical linkage movable to a second position actuating said main circuit breaker such that the pair of contactors of said main circuit breaker are open and such that the pair of contactors of said grounding switch are closed, said mechanical linkage comprising:

an actuator that is movable between a first position and a second position, said actuator movable from the first position to the second position upon detection of a fault in electrical power from said electrical power inlet; and a yoke connected to said actuator, said yoke connected to one of said pair of contactors of said main circuit breaker and to one of said pair of contactors of said grounding switch, a movement of said actuator to the second position causing the pair of contactors of said main circuit breaker to open and the pair of contactors of said grounding switch to close.

2. The circuit breaker apparatus of claim 1, said electrical power outlet being a main bus having at least a portion positioned in said housing, said main circuit breaker electrically connected to said main bus when the of contactors of said main circuit breaker are closed.

3. The circuit breaker apparatus of claim 2, further comprising:

a switch disconnect positioned in said housing, said switch disconnect movable between a first position which electrically connects said main circuit breaker to said main bus and a second position electrically isolating said main circuit breaker from said main bus.

4. The circuit breaker apparatus of claim 1, said grounding switch extending in generally transverse relationship to said main circuit breaker.

5. The circuit breaker apparatus of claim 1, said yoke being pivotally mounted within said housing.

6. The circuit breaker apparatus of claim 1, said yoke having a generally L-shape, said actuator having an arm connected adjacent to one end of the L-shape, the one of the pair of contactors of said grounding switch connected to a portion of the L-shape away from the one end of the L-shape, the one of the pair of contactors of said main circuit breaker connected to an opposite end of the L-shape.

7. The circuit breaker apparatus of claim 6, said actuator having a rod connected to said arm at a location away from the one end of the L-shape, said rod being resiliently mounted so as to move downwardly upon a detection of the fault in the electrical power from the electrical power inlet, the downward movement causing said rod to move said arm so as to pivot said yoke in order to open the pair of contactors of said main circuit breaker and a close the pair of contactors of said grounding switch.

8. The circuit breaker apparatus of claim 1, said main circuit breaker having a vacuum bottle in which the pair of contactors of said main circuit breaker are positioned, said grounding switch having another vacuum bottle in which the pair of contactors of said grounding switch are positioned.

9. The circuit breaker apparatus of claim 1, said electrical power inlet comprising:

a cable extending to or into said housing;

a conductor connected to said cable through a busing; and a conductive plate positioned in said housing adjacent to said main circuit breaker, said main circuit breaker being electrically connected to said conductive plate.

10. The circuit breaker apparatus of claim 1, further comprising:

a grounding bus coupled to another of the pair of contactors of said grounding switch, said grounding bus connected to ground so that the electrical power passes to ground when the pair of contactors of said main circuit breaker are open and when the pair of contactors of said grounding switch are closed.

11. The circuit breaker apparatus of claim 1, one of the pair of contactors of said main circuit breaker being movable and another of the pair of contactors of said main circuit breaker being fixed, one of the pair of contactors of said grounding switch being movable and another of the pair of contactors of said grounding switch being fixed.

12. The circuit breaker apparatus of claim 1, said electrical power inlet passing power of three phases, said main circuit breaker being three main circuit breakers respectively connected to the three phases, said grounding switch being three grounding switches respectively connected to the three phases, the mechanical linkage being connected to the three main circuit breakers and the three grounding switches.

13. The circuit breaker apparatus of claim 1, said housing having a gas release valve affixed thereto, said gas release valve movable between an open position and a closed position, said gas release valve movable to said open position when an arcing occurs within said housing.

14. The circuit breaker apparatus of claim 13, said housing having an enclosed channel cooperative with said gas release valve so as to conduct hot gas outwardly when said gas release valve is in the open position.

15. A switchgear having a plurality of the circuit breaker apparatuses of claim 1.

16. The switchgear of claim 15, the electrical power outlet being a main bus extending between the plurality of the circuit breaker apparatuses.

* * * * *